US006068710A

United States Patent [19]

Hacias

[11] Patent Number: 6,068,710

[45] Date of Patent: May 30, 2000

[54] AQUEOUS COMPOSITION AND PROCESS FOR PREPARING METAL SUBSTRATE FOR COLD FORMING

[75] Inventor: Kenneth J. Hacias, Sterling Heights, Mich.

[73] Assignee: Henkel Corporation, Gulph Mills, Pa.

[21] Appl. No.: 09/308,952

[22] PCT Filed: Nov. 18, 1997

[86] PCT No.: PCT/US97/20363

§ 371 Date: May 27, 1999

§ 102(e) Date: May 27, 1999

[87] PCT Pub. No.: WO98/23789

PCT Pub. Date: Jun. 4, 1998

Related U.S. Application Data

[60] Provisional application No. 60/032,499, Nov. 27, 1996.

[51] Int. Cl.[7] ..... C23C 22/07

[52] U.S. Cl. ..... 148/261; 106/14.12; 148/253; 148/259; 148/275

[58] Field of Search ..... 148/253, 261, 148/275, 259; 106/14.12; 427/435

[56] References Cited

U.S. PATENT DOCUMENTS

| | | | |
|---|---|---|---|
| 2,528,787 | 11/1950 | Roland | 117/127 |
| 2,992,145 | 7/1961 | Stantangelo et al. | 148/246 |
| 3,886,894 | 6/1975 | Brekle | 118/6 |
| 4,262,057 | 4/1981 | Godek et al. | 428/470 |
| 5,045,130 | 9/1991 | Gosset et al. | 148/257 |
| 5,344,505 | 9/1994 | Ouyang et al. | 148/261 |
| 5,366,569 | 11/1994 | Mueller et al. | 148/525 |
| 5,368,757 | 11/1994 | King | 252/34 |
| 5,531,912 | 7/1996 | Church et al. | 508/507 |
| 5,545,438 | 8/1996 | Ouyang et al. | 427/299 |
| 5,547,595 | 8/1996 | Hacias | 508/156 |

FOREIGN PATENT DOCUMENTS

| | | |
|---|---|---|
| 0298827 | 11/1989 | European Pat. Off. . |
| 0363200 | 11/1990 | European Pat. Off. . |
| 95 31297 | 11/1995 | WIPO . |

*Primary Examiner*—Anthony Green
*Attorney, Agent, or Firm*—Wayne C. Jaeschke; Stephen D. Harper; Norvell E. Wisdom, Jr.

[57] ABSTRACT

Aqueous liquid treatment compositions comprising as active ingredients boric acid and condensed phosphate ions can form iron phosphate containing conversion coatings on ferriferous substrates at rates of at least 0.3 $g/m^2/min$. The coatings are useful as cold working lubricants, either as such or after overcoating with a supplemental lubricant.

20 Claims, No Drawings

AQUEOUS COMPOSITION AND PROCESS FOR PREPARING METAL SUBSTRATE FOR COLD FORMING

CROSS-REFERENCE TO RELATED APPLICATION

Priority under 35 U.S.C. § 119(e) is claimed for this application from Application Serial No. 60/032,499 filed on Nov. 27, 1996.

BACKGROUND OF THE INVENTION

1. Field of the Invention

This invention relates to aqueous liquid treatment compositions suitable for forming on metal surfaces, particularly ferriferous metal surfaces, a novel coating containing a mixture of iron phosphate(s) and a boron containing lubrication promoting material. These coatings, either as applied or preferably after the application of additional lubricant materials that are already known in the art, are protective against mechanical damage during cold working of the underlying metal. Processes for using these compositions are also part of the invention.

2. Statement of Related Art

A very widely accepted currently conventional method of preparing metal surfaces for cold working is to apply a heavy zinc phosphate coating to the surface and then apply a composition containing an alkali metal soap, usually sodium stearate, which reacts with the zinc content of the zinc phosphate coating to form a very effective lubricant layer that is believed to contain zinc soap. This practice produces excellent results, but current environmental concerns militate against the use of zinc and other heavy metals such as nickel, manganese, and calcium, which are often required to obtain the best lubricant properties when using this technique. The metal soap containing coatings formed on metal surfaces in this way are also sources of a substantial dust nuisance in many cases.

Decades ago, iron phosphating was commonly used as a basis for lubricant layers for cold working metals, but the thicker layers provided by zinc phosphating generally have been found to produce more effective lubrication and thus are highly preferred. Conventional aqueous iron phosphating treatment compositions contain primarily alkali metal or ammonium phosphates, sometimes additional phosphoric acid, and usually some kind of accelerator as their active ingredients.

DESCRIPTION OF THE INVENTION

Objects of the Invention

A major object of this invention is to provide lubricants and processes that will eliminate or at least reduce the environmental disutilities noted above while still achieving cold working performance that is adequate when compared with the prior art use of phosphate conversion coatings followed by zinc soap application. Another alternative or concurrent object is to reduce total energy and/or other costs of cold forming operations, particularly by (i) reducing process related waste of objects being cold worked, (ii) achieving higher production rates per unit time, and/or (iii) reducing the number of processing steps required.

General Principles of Description

Except in the claims and the working and comparison examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, unless expressly stated to the contrary: percent, "parts" of, and ratio values are by weight; the term "polymer" includes "oligomer", "copolymer", "terpolymer", and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; specification of materials in ionic form implies the presence of sufficient counterions to produce electrical neutrality for the composition as a whole (any counterions thus implicitly specified should preferably be selected from among other constituents explicitly specified in ionic form, to the extent possible; otherwise such counterions may be freely selected, except for avoiding counterions that act adversely to the objects of the invention); and the term "mole" and its variations may be applied to elemental, ionic, and any other chemical species defined by number and type of atoms present, as well as to compounds with well defined molecules.

SUMMARY OF THE INVENTION

It has been found that an aqueous liquid treatment composition comprising, preferably consisting essentially of, or more preferably consisting of, water and a combination of:

(A) dissolved orthoboric acid (i.e., $H_3BO_3$); and (B) dissolved condensed phosphoric acids and anions derivable by neutralization thereof when contacted with ferriferous substrates, form on the substrates at least partially water insoluble coatings, which contain iron phosphate in one or more of its amorphous or crystalline forms, usually in admixture with boron containing compounds that may or may not be water soluble, and that these coatings are protective against mechanical damage during cold working of the surfaces. Treatment compositions and processes of using them are both within the intended scope of the invention, as are metal articles bearing a coating formed in such a process and liquid or solid concentrates that will form such a working aqueous liquid treatment composition according to the invention upon dilution with water only.

Description of Preferred Embodiments

In a working aqueous composition according to the invention, the concentration of orthoboric acid, component (A), preferably is, with increasing preference in the order given, at least 2, 5, 10, 20, 30, 40, 50, 55, or 60 grams per liter (hereinafter usually abbreviated as "g/l"), and if the maximum possible rate of formation of the coating is more important than economy in materials, more preferably is, with increasing preference in the order given, at least 70, 80, 90, 100, 110, or 120 g/l. These latter values are substantially above the solubility of orthoboric acid in water at normal ambient temperature and therefore can be used only in working compositions that are maintained well above normal ambient temperature. No adverse effect on the quality of the coating formed has been observed for concentrations higher than 120 g/l, but for practical convenience in handling, particularly the avoidance of unwanted precipitation in process zones that are even slightly cooler than the preferred working temperatures, normally concentrations no higher than 130 g/l are preferred.

For component (B), anions of the type formed by complete neutralization of condensed phosphoric acids are the most preferred sources, with tetrasodium pyrophosphate, i.e., $Na_4P_2O_7$, hereinafter usually abbreviated "TSPP", the single most preferred source for component (B) in most cases, as considered further below. Next most preferred, in order of decreasing preference, are tetrapotassium pyrophosphate, i.e., $K_4P_2O_7$, hereinafter usually abbreviated "TKPP", and sodium tripolyphosphate, i.e, $Na_5P_3O_{10}$, hereinafter usually abbreviated "STPP". Incompletely neutralized anions of condensed phosphoric acids are still less preferred, with preference decreasing with increasing contents of hydrogen in the anions, and totally unionized acids, to the extent that they exist at all, are least preferred.

There are two separate types of preferences with respect to the concentrations of component (B) present in the aqueous liquid treatment compositions used in the invention. The more important preference is one for the ratio of the molar concentration of boric acid to the molar concentration of anions or acids containing at least one P—O—P moiety in component (B). This ratio, hereinafter usually briefly denoted as the "BA/CP molar ratio", preferably is, with increasing preference in the order given, at least 12, 15, 18, or 21, and if a high rate of deposition of insoluble coating in a process according to the invention is desired, as would normally be true, more preferably is, with increasing preference in the order given, at least 23, 25, 27, 29, or 30. As noted in the examples below, BA/CP molar ratios of at least 85 can be highly effective. No upper limit on the BA/CP molar ratio beyond which the beneficial effects of the invention are substantially diminished has been discovered, but for the practical reason that high ratios will require low concentrations of component (B) and therefore make process control more difficult, an upper limit of 200, or more preferably 125, is generally preferred.

Subject to the preferences already noted on the BA/CP molar ratio, the molar concentration of component (B) in an aqueous liquid treatment composition according to the invention preferably is, with increasing preference in the order given, at least 0.001, 0.002, 0.004, 0.007, 0.010, 0.012, 0.014, 0.016, 0.018, 0.020, or 0.022 moles per liter (hereinafter usually abbreviated "M").

No other ingredients are essential in the aqueous liquid treatment compositions according to the invention, but surfactants may be advantageous additional constituents in order to promote wetting of the substrates being treated and/or to inhibit precipitation of boric acid or other solids from the compositions if their temperature falls slightly, when very highly concentrated compositions are used. Chlorate ions, which accelerate the formation of conversion coatings with most phosphating compositions, appear to reduce at least slightly the coating speed with compositions used according to this invention, but certainly may, along with other accelerators such as hydroxylamine, nitrate, nitrite, nitroaromatic compounds, and the like, be used if desired for some particular purpose. Similarly, orthophosphoric acid, i.e., $H_3PO_4$, and anions derivable by complete or partial neutralization thereof appear to have no particular beneficial effect in treatment compositions according to this invention, but also may be present if desired.

Aqueous liquid treatment compositions according to this invention may sometimes stain or otherwise discolor metal surfaces exposed to them. If this is undesirable, it can generally be prevented by including in the working composition a suitable corrosion inhibitor as an optional component (C). A particularly preferred component (C) comprises, more preferably consists essentially of, or still more preferably consists of:

(C.1) a primary inhibitor component selected from the group consisting of non-sulfur-containing organic azole compounds, preferably organic triazoles, more preferably benzotriazole or tolyltriazole; and (C.2) a secondary inhibitor component selected from the group consisting of organic azoles that also contain mercapto moieties, preferably mercaptobenzothiazole or mercaptobenzimidazole.

With this preferred corrosion inhibitor, the concentration of component (C.1) in a working aqueous liquid composition according to this invention preferably is, with increasing preference in the order given, not less than 10, 40, 100, 200, 400, 800, 1200, 1400, 1600, 1800, 2000, 2100, 2200, 2300, 2400, 2450, or 2480 parts per million (hereinafter usually abbreviated "ppm") of the total composition and independently preferably is, with increasing preference in the order given, not more than 20,000, 10,000, 5000, 4000, 3800, 3600, 3300, 3000, 2900, 2800, 2750, 2700, 2675, 2650, 2625, 2600, 2575, 2550, or 2525 ppm. For a concentrate, these concentrations should be increased to correspond to the expected dilution factor when the concentrate is used to make a working composition.

Independently, as already noted above, it is preferred for component (C.1) to be selected from benzotriazole and tolyltriazole, and in fact a mixture of these two is more preferred than either of them alone. The amount of each of benzotriazole and tolyltriazole in a composition according to the invention, expressed as a percentage of the total of component (C.1), preferably is, with increasing preference in the order given, independently for each of these two triazoles, not less than 5, 10, 15, 20, 25, 30, 35, 38, 41, 43, 45, 47, 48, or 49% and independently preferably is, with increasing preference in the order given, not more than 95, 90, 85, 80, 75, 70, 65, 62, 59, 57, 55, 53, 52, or 51%. These ratios, unlike the concentration preferences stated above, apply exactly to concentrates as well as to working compositions.

When present, the concentration of component (C.2) in a working aqueous liquid composition according to this invention preferably is, with increasing preference in the order given, not less than 1, 4, 10, 15, 30, 60, 80, 100, 120, 128, 135, 140, 145, or 149 ppm of the total composition and independently preferably is, with increasing preference in the order given, not more than 2000, 1000, 500, 350, 300, 250, 200, 215, 205, 195, 185, 175, 170, 165, 160, 158, 156, 155, 154, 153, 152, or 151 ppm. The ratio of the concentration of component (C.2) to the concentration of component (C.1) preferably is, with increasing preference in the order given, not less than 0.001:1, 0.002:1, 0.004:1, 0.007:1, 0.015:1.0, 0.030:1.0, 0.040:1.0, 0.045:1.0, 0.050:1.0, 0.053:1.0, 0.056:1.0, or 0.059:1.0 and independently preferably is, with increasing preference in the order given, not more than 2:1, 1:1, 0.5:1, 0.3:1, 0.2:1, 0.15:1.0, 0.10:1.0, 0.080:1.00, 0.070:1.00, 0.067:1.00, 0.065:1.00, 0.063:1.00, or 0.061:1.00. These ratios, like the preferences for the percentages of the two preferred constituents of component (C.1) stated above, apply exactly to concentrates as well as to working compositions.

The pH of working compositions according to this invention preferably is, with increasing preference in the order given, not less than 3, 4, 5.0, 5.1, 5.2, or 5.3 and independently preferably is, with increasing preference in the order given, not more than 9, 8.0, 7.7, 7.5, or 7.4; and if high speed coating is desired more preferably is not more than, with increasing preference in the order given, 7.0, 6.7, 6.5, 6.3, or 6.1. If necessary to obtain a pH within the preferred range, alkaline or acid materials may be added to the other ingredients of a composition according to the invention as specified above. Normally, no such addition will be needed.

For various reasons it is often preferred that the compositions according to the invention be free from various materials often used in prior art coating compositions. In particular, compositions according to this invention in most instances preferably contain, with increasing preference in the order given, and with independent preference for each component named, not more than 5, 4, 3, 2, 1, 0.5, 0.25, 0.12, 0.06, 0.03, 0.015, 0.007, 0.003, 0.001, 0.0005, 0.0002, or 0.0001% of each of (i) hydrocarbons, (ii) fatty oils of natural origin, (iii) other ester oils and greases that are liquid at 25° C., (iv) metal salts of fatty adds, (v) hexavalent chromium, (vi) nickel cations, (vii) cobalt cations, (viii) copper cations, (ix) manganese in any ionic form, (x) graphite, (xi) molybdenum sulfide, (xii) copolymers of styrene and maleic moieties, (xiii) oxidized polyethylene, (xiv) urethane polymers and copolymers, (xv) zinc cations, (xvi) at least partially neutralized copolymers of (xvi.i) an alkene that contains no carboxyl or carboxylate group and (xvi.ii) a comonomer that is an organic acid including the moiety C═C—COOH; (xvii) polyoxyalkylene polymers not containing an end group having at least 17 carbon atoms in a chain without any intervening carbon-oxygen bonds; and (xviii) alkoxylates of Guerbet alcohols. (For purposes of this description, the term "maleic moiety" is defined as a portion of a polymer chain that conforms to one of the following general chemical formulas:

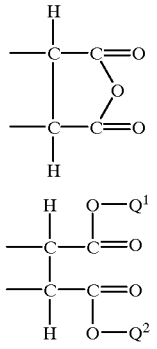

wherein each of $Q^1$ and $Q^2$, which may be the same or different, is selected from the group consisting of hydrogen, alkali metal, ammonium, and substituted ammonium cations.)

The temperature of an aqueous liquid treatment composition according to this invention during contact with the metal substrate being treated preferably is, with increasing preference in the order given, not less than 30, 40, 50, 55, 60, or 63° C. and independently preferably is, with increasing preference in the order given, not more than 97, 90, 87, or 85° C., and, in order to increase the useful working life of the composition, more preferably is, with increasing preference in the order given, not more than 83, 81, 79, or 78° C.

After storage at temperatures within the most preferred working ranges for several hours, an aqueous liquid treatment composition according to the invention almost always will form insoluble coatings less rapidly than before, and in many cases will no longer form insoluble coatings at all. It is known that condensed phosphate anions are hydrolyzed fairly rapidly at nearly neutral pH values and even more rapidly as the pH becomes more acidic, and that at any pH, hydrolysis rates increase with increasing temperature. See, e.g., VanWazer et al., *Journal of the American Chemical Society,* 77, 287 et seq. (1955). It is believed that this is at least one major reason for the diminished ability of an aqueous liquid treatment composition according to this invention to form a coating after using or storing it at high temperature for several hours. In any case, it is preferred, with increasing preference in the order given, that any aqueous liquid treatment composition according to the invention that is not being used, but is intended to be used again, should be stored at a temperature not greater than, with increasing preference in the order given, 50, 40, 35, 30, 27, or 24° C.

An aqueous liquid treatment composition may be used according to this invention in at least two different ways. The iron phosphate containing, water insoluble coating formed by contacting a ferriferous metal substrate with such a composition may be made the predominant component of the final conversion coating formed by thoroughly rinsing the surface after contact with an aqueous liquid treatment composition according to the invention for a suitable time, typically five to ten minutes at preferred conditions of temperature and component concentrations, to deposit a coating of the desired thickness. When a process according to the invention is practiced in this manner, the specific areal density, also called "add-on weight" or "add-on mass", of the water insoluble coating formed preferably is, with increasing preference in the order given, at least 0.1, 0.3, 0.5, 0.7, 0.8, 0.9, 1.0, 1.1, 1.2, 1.3, or 1.4 grams per square meter (hereinafter usually abbreviated "$g/m^2$), and independently preferably is, with increasing preference in the order given, not more than 10, 5, 4, 3.5, 3.0, 2.7, or 2.4 $g/m^2$. The upper limits are preferred primarily for economic reasons; no adverse technical effects from still higher add-on masses have been noted.

If the coatings formed in a process according to the invention have been thoroughly rinsed before being dried, most of the coating has a fairly normal, opaque and usually colored, appearance for an iron phosphate coating, but part of the coating may have a semi-transparent or glassy appearance when examined under magnification. The nature of this part of the coating is unknown; however, difficultly water soluble boron phosphate glasses have been reported in some literature.

Alternatively, a coating may be formed according to the invention by coating the substrate with a liquid film, substantially uniform in thickness, of an aqueous liquid treatment composition as described above and then drying the liquid film into place on the substrate surface. When this method is used, a substantial fraction of the total mass of the coating formed is usually water soluble and is believed to be largely boric acid and/or one of its salts. These materials themselves are known to have at least moderate lubricating effect and therefore would presumably not be harmful to any subsequent cold working operation that stresses any substrate surfaces coated according to this embodiment of the invention.

Irrespective of whether or not a wet coating formed by a process according to the invention has been rinsed or not before being dried, the dried coating may be, and usually preferably is, coated with additional lubricant materials known per se in the art before being cold worked. A wide variety of oils and greases, along with other materials, are known for this purpose. A particularly preferred supplemental lubricant of this type includes as a principal constituent ethoxylated straight chain aliphatic alcohol molecules, wherein the initial alcohol molecules have a single —OH moiety and at least 18 carbon atoms. The molecules of this supplemental lubricant preferably have a chemical structure that can be produced by condensing ethylene oxide with primary, most preferably straight chain, aliphatic monoalcohols that have, with increasing preference in the order given, at least 25, 30, 35, 40, 43, 46 or 48 carbon atoms per molecule and independently, with increasing preference in the order given, not more than 65, 60, 57, 55, 52, or 51 carbon atoms per molecule. Independently, these actual or hypothetical precursor aliphatic alcohols preferably have no functional groups other than the single —OH moiety, and, optionally but less preferably, also fluoro and/or chloro moieties. Independently, it is preferred that these molecules of ethoxylated alcohols contain, with increasing preference in the order given, at least 20, 30, 35, 40, 43, 47, or 49%, and independently preferably contain, with increasing preference in the order given, not more than 80, 70, 62, 57, 54, or 51%, of their total mass in the oxyethylene units. This preferred type of supplemental lubricant can readily be obtained in the form of dispersions in water for convenient application over a dried coating formed by a primary process according to this invention. Preferred compositions and methods for using them are described in U.S. Pat. Nos. 5,368,757 of Nov. 29, 1994 to King, 5,531,912 of Jul. 2, 1996 to Church et al., and 5,547,595 of Aug. 20, 1996 to Hacias and in PCT Application US95/05010 filed Apr. 26, 1995 and published as WO 95/31297. The complete disclosures of these noted U.S. Patents and of the noted PCT publication, except to the extent that (i) any of these disclosures may be inconsistent with any explicit statement herein or (ii) the disclosure of one of them may be inconsistent with a later filed another one of them, are hereby incorporated herein by reference.

The practice of this invention may be further appreciated by consideration of the following, non-limiting, working examples, and the benefits of the invention may be further appreciated by reference to the comparison examples. (Note: All materials identified below by one of the trademarks BONDERITE® and BONDERLUBE® are commercially available from the Henkel Surface Technologies Div. of Henkel Corp., Madison Heights, Mich., together with directions for use as used below, to the extent that the use is not explicitly described below.)

Example and Comparison Example Group 1

In this group, various aqueous liquid treatment compositions were prepared and tested for formation of any water insoluble coating on steel substrates. Compositional details are given in Table 1. Any tests that do not produce detectable amounts of water insoluble coating describe comparison examples not according to this invention.

In Table 1, the compositions with a test number including the symbol group ".1" were initially prepared from the ingredients shown on the same line as this test number; the balance of the composition was water. When the test number includes a symbol group of the form "y.x", with y being an integer that is at least 1 and x being an integer greater than 1, the composition contained all the ingredients shown in the table for all the preceding test numbers including symbols of the form "y.z", where z is an integer that is at least 1 but is not more than (x−1), and also any additional ingredients shown in the line for the test number itself. In operational terms, this means that a composition of ingredients shown in the line for test number y.1 was made up from fresh ingredients, but that later compositions with Test Numbers also beginning with y, if they contained new ingredients, were made simply by adding these new ingredients to the composition for the immediately preceding Test Number.

In some cases, the compositions were subjected to aging, either at working temperature or some other temperature, and then tested again, without adding any new ingredients to them. In such cases, the line for the corresponding Test Number does not show any new ingredients, but a comment giving particulars appears in the rightmost column of the table.

The pH values shown in Table 1 were measured at 21° C., on the total composition unless a comment indicates to the contrary. For many of the test compositions, the pH could not be measured, because the composition solidified upon lowering its temperature from the working temperature to 21° C.

TABLE 1

| Test | Grams per Liter in Test Composition of: | | | | | | pH of Test | Water Insoluble | |
|---|---|---|---|---|---|---|---|---|---|
| Number | $Na_2B_4O_7$ | $H_3BO_3$ | $Na_3PO_4$ | $Na_4P_2O_7$ | $K_4P_2O_7$ | $Na_5P_3O_{10}$ | Composition | Coating, g/m$^2$ | Comments |
| 1.1 | 60 | — | — | 6 | — | — | nm | none | |
| 1.2 | — | — | — | — | — | — | nm | none | 1.2 g/l of Sodium m-Nitrobenzene sulfonate |
| 1.3 | — | — | — | — | — | — | nm | none | 1.2 + 1.5 g/l of $Na_2MoO_4$ |
| 1.4 | — | — | — | — | — | — | nm | none | 1.3 + 1.5 g/l of $H_3PO_4$ |
| 1.5 | — | — | — | — | — | — | nm | none | 1.4 + 4.5 g/l of $H_3PO_4$ |
| 2.1 | — | 60 | — | — | — | — | nm | none | |
| 2.2 | — | 60 | 6 | — | — | — | nm | none | |
| 2.3 | — | — | — | 6 | — | — | nm | apparent iron phosphate | |
| 2.4 | 30 | — | — | — | — | — | nm | none | |
| 3.1 | — | 60 | — | 6 | — | — | 5.6 | 1.5 | 5 min at 84° C.; total dried in place coating 3.2 g/m$^2$ |
| 3.2 | — | — | — | — | — | — | nm | nm, but same visual appearance as 3.1 | A total of 0.46 M$^2$ per liter of composition was processed for 5 min in the same composition, with no replenishment and no sludge formation. |
| 3.3 | — | — | — | — | — | — | nm | bath precipitated | 5.5 g/l of dispersed ethoxylated alcohol added |

TABLE 1-continued

| Test | Grams per Liter in Test Composition of: | | | | | | pH of Test | Water Insoluble | |
|---|---|---|---|---|---|---|---|---|---|
| Number | $Na_2B_4O_7$ | $H_3BO_3$ | $Na_3PO_4$ | $Na_4P_2O_7$ | $K_4P_2O_7$ | $Na_5P_3O_{10}$ | Composition | Coating, g/m$^2$ | Comments |
| 4.1 | — | 60 | — | 6 | — | — | nm | light coating | kept at 88° C. 5 hours before use |
| 1.1 | 60 | — | — | 6 | — | — | nm | none | |
| 1.2 | — | — | — | — | — | — | nm | none | 1.2 g/l of Sodium m-Nitrobenzene sulfonate |
| 1.3 | — | — | — | — | — | — | nm | none | 1.2 + 1.5 g/l of $Na_2MoO_4$ |
| 1.4 | — | — | — | — | — | — | nm | none | 1.3 + 1.5 g/l of $H_3PO_4$ |
| 1.5 | — | — | — | — | — | — | nm | none | 1.4 + 4.5 g/l of $H_3PO_4$ |
| 2.1 | — | 60 | — | — | — | — | nm | none | |
| 2.2 | — | 60 | 6 | — | — | — | nm | none | |
| 2.3 | — | — | — | 6 | — | — | nm | apparent iron phosphate | |
| 2.4 | 30 | — | — | — | — | — | nm | none | |
| 3.1 | — | 60 | — | 6 | — | — | 5.6 | 1.5 | 5 min at 84° C.; total dried in place coating 3.2 g/m$^2$ |
| 3.2 | — | — | — | — | — | — | nm | nm, but same visual appearance as 3.1 | A total of 0.46 M$^2$ per liter of composition was processed for 5 min in the same composition, with no replenishment and no sludge formation. |
| 3.3 | — | — | — | — | — | — | nm | bath precipitated | 5.5 g/l of dispersed ethoxylated alcohol added |
| 4.1 | — | 60 | — | 6 | — | — | nm | light coating | kept at 88° C. 5 hours before use |
| 4.2 | — | — | — | 2.5 | — | — | 6.0 | 1.5 | 0.81 M$^2$/L total area coated after the addition of more TSPP and before making this measurement; dried in place total 3.4 g/m$^2$ |
| 4.3 | — | — | — | — | — | — | nm | nm, but appeared uniformly coated, less densely than 4.2 | Aged 16 hours at ambient temperature since 4.2; coating on bar sample for drawing test |
| 4.4 | — | — | — | — | — | — | nm | none, by visual judgement | Aged several hours at 74° C. since 4.3 and coating attempted at 74° C. |
| 4.5 | — | — | — | 2.5 | — | — | nm | nm, but appeared well coated | Coating at 74° C. on bar sample for drawing test |
| 4.6 | — | — | — | — | — | — | nm | none, by appearance | Aged about two hours at 74° C. since Test 4.5; total of 1.3 M$^2$/L of composition coated since make-up of the solution |
| 4.7 | — | 6 | — | — | — | — | nm | heavy, by appearance | Within a few minutes of Test 4.6, after adding more boric acid |
| 4.8 | — | — | — | — | — | — | nm | none | Aged a few hours at 74° C. and overnight at ambient temperature |
| 4.9 | — | — | — | — | — | 2.5 | nm | At least moderate, by appearance | Within a few minutes of 4.8, after addition of STPP |
| 5.1 | — | 60 | — | — | — | 6 | 5 | 0.13 | |
| 5.2 | — | — | — | — | — | 6 | 5.6 | 0.01 | Coating looked heavier, may not have stripped properly |
| 5.3 | — | — | — | — | — | — | 6.0 | none | 5 panels coated and 1 g/l of $Na_2CO_3$ added after Test 5.2 |
| 5.4 | — | — | — | — | — | 3 | 6.5 | 0.32 | 2 g/l of $Na_2CO_3$ added after Test 5.3 |
| 5.5 | — | — | — | — | — | 3 | 6.8 | 0.58 | |
| 6.1 | — | 30 | — | 6 | — | — | 7.3 | 0.65 | |
| 6.2 | — | — | — | — | — | 6 | 6.9 | 0.26 | Aged (unheated) 72 hours between 6.1 and 6.2 |
| 7 | — | 30 | — | 12 | — | — | 6.5 | none | |
| 8.1 | — | 30 | — | 3 | — | — | 6.3 | 0.58 | Reacted at 80° C. |
| 8.2 | — | — | — | — | — | — | 6.3 | none | Reacted at 89° C. |
| 8.3 | — | — | — | — | — | — | 6.3 | 0.71 | Substrate pickled before coating at 80° C. |
| 9.1 | — | 120 | — | 8 | — | — | nm | 1.77 | pH unmeasurable because solution solidified on cooling |
| 9.2 | — | — | — | — | — | — | nm | 2.33 | Coated 11 min instead of usual 5 min |
| 9.3 | — | — | — | — | — | — | nm | 1.35 | Composition aged ~7 hours at 77° C. & ~17 hours at 20–25° C. since make-up; dried in place mass of 4.8 g/m$^2$ |
| 9.4 | — | — | — | — | — | — | nm | 1.23 | Composition aged ~7 hours at 77° C. since Test 9.3 |
| 9.5 | — | — | — | — | — | — | nm | 0.99 | Composition aged ~18 hours at 20–25° C. since Test 9.4 |
| 9.6 | — | — | — | — | — | — | nm | 1.62 | Coating for 10 min within 30 min of completing Test 9.5 |

TABLE 1-continued

| Test | Grams per Liter in Test Composition of: | | | | | | pH of Test | Water Insoluble | |
|---|---|---|---|---|---|---|---|---|---|
| Number | $Na_2B_4O_7$ | $H_3BO_3$ | $Na_3PO_4$ | $Na_4P_2O_7$ | $K_4P_2O_7$ | $Na_5P_3O_{10}$ | Composition | Coating, g/m$^2$ | Comments |
| 9.7 | — | — | — | — | — | — | nm | 0.65 | Composition aged ~14 hours at 77° C. & ~34 hours at 20–25° C. since Test 9.6 |
| 9.8 | — | — | — | — | — | — | nm | 0.42 | 1 g/l of hydroxylamine sulfate added since Test 9.7 |
| 9.9 | — | — | — | 2 | — | — | nm | 0.61 | Within 30 min after Test 9.8 |
| 9.10 | — | — | — | — | — | — | nm | nm; striking gold color | 1 g/l of hydroxylamine sulfate added since Test 9.9 |
| 10.1 | — | 120 | — | 8 | — | — | nm | 1.55 | |
| 10.2 | — | — | — | — | — | — | mn | 1.52 | 0.5 g/l of Triton ™ H-66 added in hope of hindering precipitation of the solutes on cooling |
| 10.3 | — | — | — | — | — | — | nm | 1.51 | Additional 0.5 g/l of Triton ™ H-66 added; still some precipitation on cooling to 21° C. |
| 10.4 | — | — | — | — | — | — | nm | 1.23 | Coating at 66° C. |
| 10.5 | — | — | — | — | — | — | nm | 1.35 | Composition aged ~20 hours at ambient since Test 10.4 |
| 10.6 | — | — | — | — | — | — | nm | 1.40 | Composition aged 1 day, at ambient except for 7 hours at 90° C., since Test 10.5 |
| 10.7 | — | — | — | — | — | — | 5.36 | 1.00 | Aged 1 day at ambient since Test 10.6; pH measured on super-saturated solution; coating at 80° C. instead of 77° C. |
| 10.8 | — | — | — | — | — | — | nm | 0.68 | Aged 7 hours at 70–80° C. after Test 10.7 |
| 10.9 | — | — | — | — | — | — | nm | 0.45 | Aged 8 additional days at ambient after Test 10.8; coating at 82° C. |
| 10.10 | — | — | — | 2 | — | — | nm | 0.71 | Coating within 30 min after Test 10.9 at 82° C.; composition notably cloudy |
| 11 | — | 90 | — | 8 | — | — | nm | nm | Total coating mass (dried in place): 2.91 g/m$^2$; moisture pickup by coating 23% |
| 12.1 | — | — | — | 3 | — | — | 6.5 | 0.13 | +30 g/l of each of $NaH_2PO_4$ and $Na_2HPO_4$; coating time 10 min |
| 12.2 | — | — | — | 3 | — | — | 6.5 | 0.97 | Coating time 10 min |
| 12.3 | — | — | — | — | — | — | nm | nm | 12 Panels processed, with no sludge formation, between 12.1 and 12.3; total coating mass dried in place 3.04 g/m$^2$ |
| 13.1 | — | 120 | — | 6 | — | — | nm | 1.49 | Soluble coating mass 2.7 g/m$^2$; gained 36% total moisture at 96% RH and 22° C. |
| 13.2 | — | — | — | — | — | — | nm | 4.79 | 10 min coating of pickled rod; also had soluble coating mass of 5.13 g/m$^2$ |
| 13.3 | — | — | — | — | — | — | nm | 4.45 | 20 min coating of pickled rod; also had soluble coating mass of 7.4 g/m$^2$ |
| 14.1 | — | 120 | — | — | 8 | — | nm | 0.58 | 10 min coating; also had soluble coating mass of 2.94 g/m$^2$ |
| 14.2 | — | — | — | — | — | — | nm | 0.64 | 10 min coating after bath sat 24 hours |
| 14.3 | — | — | — | — | — | 4 | nm | 0.38 | 10 min coating |
| 15.1 | — | 120 | — | 6 | — | — | nm | 2.42 | 10 min coating |
| 15.2 | — | — | — | — | — | — | nm | 1.52 | Also had 3.88 g/m$^2$ of soluble coating |
| 15.3 | — | — | — | — | — | — | nm | 3.14 | HCl pickled wire rod substrate; also had 0.73 g/m$^2$ of soluble coating when dried in place |
| 15.4 | — | — | — | — | — | — | nm | 1.16 | 1 g/l of $NaClO_3$ added |
| 15.5 | — | — | — | — | — | — | nm | 1.00 | Another 1 g/l of $NaClO_3$ added |
| 16.1 | — | 120 | — | 8 | — | — | nm | 1.62 | |
| 16.2 | — | — | — | 8 | — | — | nm | 1.94 | |
| 16.3 | — | — | — | — | — | — | nm | 1.51*<br>1.29** | Bath had sat 3 weeks at 20–25° C. since 16.2.<br>*Without agitation during coating<br>**With agitation during coating |

Notes for Table 1
"nm" means "not measured".

Unless otherwise noted in a comment, values in the column of the table headed by the words "Water Insoluble Coating, g/m$^2$" were obtained by contacting the compositions with clean sheet steel panels for 5 minutes at a temperature of 77° C. Quantitative values shown in the Table were obtained by conventional stripping of the coating formed in a solution of 0.5% $CrO_3$ in water.

The following conclusions were deduced from the results in Table 1:

Tests with a number beginning with "1." indicate that sodium tetraborate is ineffective in promoting formation of insoluble coatings, either by itself or in the presence of conventional accelerators such as nitrobenzene sulfonate and molybdate, even if the acidity is raised. Tests 2.1 and 2.2 indicate that boric acid by itself or with uncondensed phosphate anions is equally ineffective. In contrast, the combination of boric acid and condensed phosphate, first shown in the Table in Test 2.3, does promote the formation of insoluble coating. This coating promoting effect is not destroyed by the presence of uncondensed phosphate anions in the aqueous liquid treatment composition according to the invention, but it can be destroyed by condensed borate salts as shown by comparing Tests 2.2 and 2.3.

Tests 3.1 to 4.4 show that freshly made compositions containing only boric acid and TSPP as active ingredients promote fairly rapid formation of insoluble coating, but that this ability can be weakened or even destroyed by storage of the compositions, particularly at elevated temperatures. The coating promotion effect can be restored in such stored compositions by adding more TSPP, as indicated by comparing Tests 4.4 and 4.5. After sufficient use, the coating promotion effect can also be destroyed by apparent depletion of boric acid, as indicated by comparing Tests 4.6 and 4.7. The coating promoting effect contributed by boric acid to the boric acid and condensed phosphate combination is apparently not depleted quickly if at all by storage alone, as indicated by comparison among Tests 4.6 through 4.9.

Tests with numbers beginning with 5. show that STPP can be substituted for TSPP in the combination, but it produces much lower coating masses that does TSPP and is more rapidly rendered ineffective by use of the composition than is TSPP. Tests 5.4 and 5.5 indicate that pH values above 6 produce faster coating than those below 6.

Tests with numbers from 6.1 through 8.3 show that concentrations of boric acid at least as low as 30 g/l are workable, but only if the concentration of condensed phosphates is not too high (Test 7). Coating speeds are lower than with higher concentrations of boric acid, and can be significantly reduced by operating temperatures above 80° C. (Test 8.2).

Tests 9.1 through 11, 13.1 through 13.3, and 15.1 through 16.3 show that very high concentrations of boric acid, combined with adequate but relatively small amounts of TSPP, generally result in the highest coating speeds of any compositions tested. As with aqueous liquid treatment compositions according to the invention with lower concentrations of boric acid, the coating promoting effectiveness of the pyrophosphate can be destroyed by storage, especially at high temperature, but at lower storage temperatures this destruction is much slower than in compositions with lower concentrations of boric acid (see especially test numbers beginning with 16.). As with compositions according to the invention having lower boric acid concentrations, the insoluble coating promoting effectiveness of the compositions can be largely restored by additions of fresh pyrophosphate anions. Surfactants cause little or no loss in coating speed (Tests 10.2 and 10.3) and are at least partially effective in reducing the danger of unwanted solidification of the composition when its temperature is lowered enough to make it supersaturated in boric acid. Surfactants also promote facile wetting of the substrates to be treated. Addition of hydroxylamine sulfate or of chlorate, widely used as phosphating accelerators in conventional phosphate conversion coating forming compositions, depresses the coating rates of these compositions (Tests 9.8, 15.4, and 15.5).

Tests 12.1–12.3 show that TSPP along with uncondensed phosphates promotes the formation of insoluble coatings when present in sufficient amounts (compare Test 12.2 with 12.1), but the insoluble coating rate formation is still substantially less than in the preferred compositions containing boric acid. Tests 14.1 through 14.3 show that TKPP is substantially better in producing rapid coatings than is STPP, but still not as good as TSPP.

In order to exhibit more clearly the effect of the boric acid to condensed phosphate ratio and the concentrations of those two materials, those Test Numbers from Table 1 that were used for coating shortly after preparing any aqueous liquid treatment compositions possibly according to the invention (thereby avoiding the complication of the loss of coating promoting effectiveness of the condensed phosphate with time) are reproduced in Table 2 below in order of increasing boric acid concentrations and, at constant boric acid concentration, in order of increasing condensed phosphate anion concentration, except that the results for condensed phosphates other than TSPP are shown in the bottom two rows of the table. The coating time for each entry in Table 2 was 5 min unless otherwise noted.

As shown by the results in Table 2, the insoluble coating formation rate for five minute coating times in aqueous liquid treatment compositions according to the invention that contain only TSPP as component (B) varies only from 0.30 to 0.39 g/m$^2$/min for molar ratios from 85 to 32.3, but then falls drastically at a molar ratio of 21.5 and falls to undetectable levels at a ratio of either 10.7 or infinity.

TABLE 2

| Test Number (from Table 1) | Moles per Liter of: $H_3BO_3$ | Moles per Liter of: Condensed Phosphate | Molar Ratio, $H_3BO_3$:condensed phosphate | Coating Temperature, °C. | Insoluble Coating, g/m$^2$/min |
|---|---|---|---|---|---|
| 6.1 | 0.485 | 0.0226 | 21.5 | 77 | 0.13 |
| 7 | 0.485 | 0.0451 | 10.7 | 77 | 0.00 |
| 3.1 | 0.97 | 0.0226 | 42.9 | 84 | 0.30 |
| 2.1 | 0.97 | 0 | ∞ | 77 | 0.00 |
| 13.1 | 1.94 | 0.0226 | 85.8 | 77 | 0.30 |

TABLE 2-continued

| Test Number (from Table 1) | Moles per Liter of: $H_3BO_3$ | Condensed Phosphate | Molar Ratio, $H_3BO_3$:condensed phosphate | Coating Temperature, °C. | Insoluble Coating, g/m²/min |
|---|---|---|---|---|---|
| 15.2 | 1.94 | 0.0226 | 85.8 | 77 | 0.30 |
| 15.1 | 1.94 | 0.0226 | 85.8 | " | 0.24 (10 min) |
| 9.1 | 1.94 | 0.0301 | 64.7 | 77 | 0.35 |
| 9.2 | 1.94 | 0.0301 | 64.7 | " | 0.23 (10 min) |
| 10.1 | 1.94 | 0.0301 | 64.7 | 77 | 0.31 |
| 16.1 | 1.94 | 0.0301 | 64.7 | 77 | 0.32 |
| 16.2 | 1.94 | 0.0602 | 32.3 | 77 | 0.39 |
| 14.1 | 1.94 | 0.0301 | 80.8 | 77 | 0.12 (10 min) |
| 5.1 | 0.97 | 0.0301 | 59.5 | 72 | 0.03 |

Example and Comparison Example Group 2

A wire drawing bar coated as described above for Test Number 4.3 was dried and then dipped for 2 seconds into a mixture of BONDERLUBE® 234 lubricant concentrate, diluted according to the manufacturer's directions, and 30 g/l of UNITHOX™ 750 ethoxylated alcohol. A comparison bar with no conversion coating formed on it was similarly lubricated, and both were drawn with a conventional half-button die with a clamping force of 27 kilograms-force per square centimeter. The comparison bar without a conversion coating exhibited bright spots after drawing and had obvious sharp drawing force spikes between drawing forces ranging from 3.0 to 4.1 kilograms-force per square centimeter. The bar coated according to the invention, in contrast, exhibited much more desirable drawing behavior: The drawing force required for it under the same conditions began at 3.3 kilograms-force per square centimeter and smoothly and monotonically decreased to 3.0 kilograms-force per square centimeter by the end of the test. The surface of this bar after drawing was uniform in appearance.

A wire drawing bar coated as described above for Test Number 4.5 was dried and then coated as above and drawn similarly except at a clamping force of 38 kilograms-force per square centimeter. A comparison bar was coated with BONDERITE® 181 conversion coating composition recommended for lubricant base coatings and then lubricated as above. The bar coated according to the invention drew smoothly at a force starting at 4.63 kilograms-force per square centimeter, declining monotonically to 3.9 kilograms-force per square centimeter. The comparison bar failed at 37 kilograms-force per square centimeter of clamping force.

What is claimed is:

1. An aqueous liquid treatment composition for ferriferous metal surfaces, said composition consisting essentially of water and the following dissolved components:

(A) a concentration that is at least about 5 g/l of boric acid (which has the chemical formula $H_3BO_3$); and (B) dissolved condensed phosphoric acids and anions derivable by neutralization thereof in an amount such that the molar ratio of boric acid to the total of condensed phosphoric acids and anions derivable by neutralization thereof is from about 12 to about 200.

2. A composition according to claim 1, wherein the concentration of boric acid is at least about 30 g/l and the molar ratio of boric acid to the total of condensed phosphoric acids and anions derivable by neutralization thereof is from about 21 to about 125.

3. A composition according to claim 2, wherein the molar ratio of boric acid to the total of condensed phosphoric acids and anions derivable by neutralization thereof is from about 30 to about 125.

4. A composition according to claim 3, wherein the concentration of boric acid is at least about 60 g/l.

5. A composition according to claim 4, wherein the concentration of boric acid is at least about 110 g/l.

6. A composition according to claim 5, wherein component (B) is tetrasodium pyrophosphate.

7. A composition according to claim 4, wherein component (B) is tetrasodium pyrophosphate.

8. A composition according to claim 3, wherein component (B) is tetrasodium pyrophosphate, tetrapotassium pyrophosphate, or a mixture thereof.

9. A composition according to claim 2, wherein component (B) is tetrasodium pyrophosphate, tetrapotassium pyrophosphate, sodium tripolyphosphate, or a mixture thereof.

10. A composition according to claim 1, wherein component (B) is tetrasodium pyrophosphate, tetrapotassium pyrophosphate, sodium tripolyphosphate, or a mixture thereof.

11. A process of forming on a ferriferous metal substrate a composition that directly acts to reduce mechanical stress on the substrate when the substrate is being cold worked, or anchors in place a distinct lubricating composition that acts to reduce mechanical stress on the substrate when the substrate is being cold worked, said process comprising a step of contacting the ferriferous substrate at a temperature of at least about 30 but not more than about 87° C. with a composition according to claim 10 for a time sufficient to form at least about 0.1 g/m² of water insoluble conversion coating thereon.

12. A process of forming on a ferriferous metal substrate a composition that directly acts to reduce mechanical stress on the substrate when the substrate is being cold worked, or anchors in place a distinct lubricating composition that acts to reduce mechanical stress on the substrate when the substrate is being cold worked, said process comprising a step of contacting the ferriferous substrate at a temperature of at least about 40 but not more than about 83° C. with a composition according to claim 9 for a time sufficient to form at least about 0.3 g/m² of water insoluble conversion coating thereon.

13. A process of forming on a ferriferous metal substrate a composition that directly acts to reduce mechanical stress on the substrate when the substrate is being cold worked, or anchors in place a distinct lubricating composition that acts to reduce mechanical stress on the substrate when the substrate is being cold worked, said process comprising a step of contacting the ferriferous substrate at a temperature of at least about 50 but not more than about 81° C. with a composition according to claim 8 for a time sufficient to form at least about 0.5 $g/m^2$ of water insoluble conversion coating thereon.

14. A process of forming on a ferriferous metal substrate a composition that directly acts to reduce mechanical stress on the substrate when the substrate is being cold worked, or anchors in place a distinct lubricating composition that acts to reduce mechanical stress on the substrate when the substrate is being cold worked, said process comprising a step of contacting the ferriferous substrate at a temperature of at least about 55 but not more than about 79° C. with a composition according to claim 7 for a time sufficient to form at least about 0.9 $g/m^2$ of water insoluble conversion coating thereon.

15. A process of forming on a ferriferous metal substrate a composition that directly acts to reduce mechanical stress on the substrate when the substrate is being cold worked, or anchors in place a distinct lubricating composition that acts to reduce mechanical stress on the substrate when the substrate is being cold worked, said process comprising a step of contacting the ferriferous substrate at a temperature of at least about 63 but not more than about 78° C. with a composition according to claim 6 for a time sufficient to form at least about 1.2 $g/m^2$ of water insoluble conversion coating thereon.

16. A process of forming on a ferriferous metal substrate a composition that directly acts to reduce mechanical stress on the substrate when the substrate is being cold worked, or anchors in place a distinct lubricating composition that acts to reduce mechanical stress on the substrate when the substrate is being cold worked, said process comprising a step of contacting the ferriferous substrate at a temperature of at least about 60 but not more than about 79° C. with a composition according to claim 5 for a time sufficient to form at least about 1.0 $g/m^2$ of water insoluble conversion coating thereon.

17. A process of forming on a ferriferous metal substrate a composition that directly acts to reduce mechanical stress on the substrate when the substrate is being cold worked, or anchors in place a distinct lubricating composition that acts to reduce mechanical stress on the substrate when the substrate is being cold worked, said process comprising a step of contacting the ferriferous substrate at a temperature of at least about 60 but not more than about 81° C. with a composition according to claim 4 for a time sufficient to form at least about 0.9 $g/m^2$ of water insoluble conversion coating thereon.

18. A process of forming on a ferriferous metal substrate a composition that directly acts to reduce mechanical stress on the substrate when the substrate is being cold worked, or anchors in place a distinct lubricating composition that acts to reduce mechanical stress on the substrate when the substrate is being cold worked, said process comprising a step of contacting the ferriferous substrate at a temperature of at least about 55 but not more than about 83° C. with a composition according to claim 3 for a time sufficient to form at least about 0.8 $g/m^2$ of water insoluble conversion coating thereon.

19. A process of forming on a ferriferous metal substrate a composition that directly acts to reduce mechanical stress on the substrate when the substrate is being cold worked, or anchors in place a distinct lubricating composition that acts to reduce mechanical stress on the substrate when the substrate is being cold worked, said process comprising a step of contacting the ferriferous substrate at a temperature of at least about 50 but not more than about 85° C. with a composition according to claim 2 for a time sufficient to form at least about 0.5 $g/m^2$ of water insoluble conversion coating thereon.

20. A process of forming on a ferriferous metal substrate a composition that directly acts to reduce mechanical stress on the substrate when the substrate is being cold worked, or anchors in place a distinct lubricating composition that acts to reduce mechanical stress on the substrate when the substrate is being cold worked, said process comprising a step of contacting the ferriferous substrate at a temperature of at least about 30 but not more than about 85° C. with a composition according to claim 1 for a time sufficient to form at least about 0.1 $g/m^2$ of water insoluble conversion coating thereon.

* * * * *